US006997253B2

(12) United States Patent
Webb et al.

(10) Patent No.: US 6,997,253 B2
(45) Date of Patent: Feb. 14, 2006

(54) ANTI-ROTATION METHOD AND APPARATUS FOR LIMITING ROTATION OF CEMENTING PLUGS

(75) Inventors: Earl D. Webb, Wilson, OK (US); Michael D. Stevens, Duncan, OK (US); John C. Zimmerman, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 10/758,702

(22) Filed: Jan. 15, 2004

(65) Prior Publication Data

US 2004/0261991 A1 Dec. 30, 2004

Related U.S. Application Data

(62) Division of application No. 10/201,505, filed on Jul. 23, 2002, now Pat. No. 6,796,377.

(51) Int. Cl.
*E21B 33/16* (2006.01)

(52) U.S. Cl. ..... 166/155; 166/153; 166/156; 166/242.1; 166/291

(58) Field of Classification Search ..... 166/153, 166/155, 156, 291, 285, 242.1, 326, 328, 166/329, 318
See application file for complete search history.

(56) References Cited

U.S. PATENT DOCUMENTS

| | | | | |
|---|---|---|---|---|
| 1,896,104 | A | 2/1933 | Simmons | |
| 2,165,433 | A | 7/1939 | Wickersham | |
| 2,178,847 | A | 11/1939 | Baker et al. | |
| 2,560,692 | A | 7/1951 | Hall | |
| 3,159,219 | A * | 12/1964 | Scott | 166/156 |
| 3,448,802 | A | 6/1969 | Page | |
| 3,550,683 | A | 12/1970 | Comeaux | |
| 3,818,999 | A | 6/1974 | Garrett | |
| 3,913,686 | A | 10/1975 | Manson, Jr. | |
| 4,175,619 | A | 11/1979 | Davis | |
| 4,190,111 | A | 2/1980 | Davis | |
| 4,190,112 | A | 2/1980 | Davis | |
| 4,574,883 | A | 3/1986 | Carroll et al. | |
| 4,711,300 | A | 12/1987 | Wardlaw, III et al. | |
| 4,836,279 | A | 6/1989 | Freeman | |
| 4,858,687 | A | 8/1989 | Watson et al. | |
| 4,907,649 | A * | 3/1990 | Bode | 166/70 |
| 4,979,562 | A | 12/1990 | Langer | |
| 5,025,858 | A | 6/1991 | Glaser | |

(Continued)

FOREIGN PATENT DOCUMENTS

DE 3036110 A * 4/1982

(Continued)

OTHER PUBLICATIONS

Foreign communication from a related counterpart application dated Jan. 20, 2005.

*Primary Examiner*—David Bagnell
*Assistant Examiner*—Shane Bomar
(74) *Attorney, Agent, or Firm*—Craig W. Roddy; McAfee & Taft P.C.

(57) ABSTRACT

An apparatus for preventing or limiting the rotation of cementing plugs in a casing string during drillout. The apparatus includes an outer housing with a sleeve disposed therein. The sleeve has an inner surface configured to engage cementing plugs received therein to cause an interference fit. The sleeve will hold the cementing plugs when rotational forces, such as drilling forces, are applied so that during drillout, rotation of the cementing plug is prevented or is at least limited.

17 Claims, 5 Drawing Sheets

U.S. PATENT DOCUMENTS 5,095,980 A 3/1992 Watson
5,113,940 A 5/1992 Glaser
5,165,474 A 11/1992 Buisine et al.
5,178,214 A * 1/1993 Bode ..... 166/70
5,234,052 A 8/1993 Coone et al.
5,246,069 A 9/1993 Glaser et al.
5,288,954 A * 2/1994 Peart et al. ..... 181/131
5,390,736 A 2/1995 Budde
5,435,386 A 7/1995 LaFleur ..... 166/156
5,562,490 A * 10/1996 Rybolt et al. ..... 439/507
5,641,021 A 6/1997 Murray et al.
5,669,457 A 9/1997 Sebastian et al.
5,772,491 A 6/1998 Watkins
5,842,517 A 12/1998 Coone
6,056,053 A 5/2000 Giroux et al.
6,240,965 B1 * 6/2001 Maimets ..... 138/98
6,425,442 B1 7/2002 Latiolais, Jr. et al.

FOREIGN PATENT DOCUMENTS

WO WO 01/09480 A1 2/2001
WO WO 01/09481 A1 2/2001

* cited by examiner

ANTI-ROTATION METHOD AND APPARATUS FOR LIMITING ROTATION OF CEMENTING PLUGS

CROSS-REFERENCE TO RELATED APPLICATION

This application is a divisional of U.S. patent application Ser. No. 10/201,505 filed Jul. 23, 2002 now U.S. Pat. No. 6,796,377.

BACKGROUND OF THE INVENTION

The present invention relates generally to drilling and completion techniques for downhole wells, and more particularly to methods and apparatus for limiting the rotation of cementing plugs being drilled out of the plugs.

In the construction of oil and gas wells, a wellbore is drilled into one or more subterranean formations or zones containing oil and/or gas to be produced. During a wellbore drilling operation, drilling fluid (also called drilling mud) is circulated through the wellbore by pumping it down the drill string, through a drill bit connected thereto and upwardly back to the surface to the annulus between the walls of the wellbore and the drill string. The circulation of the drilling fluid functions to lubricate the drill bit, remove cuttings from the wellbore as they are produced and to exert hydrostatic pressure on pressurized fluid contained formations penetrated by the wellbore whereby blowouts are prevented.

In most instances, after the wellbore is drilled, the drill string is removed and a casing string is run into the wellbore while maintaining sufficient drilling fluid in the wellbore to prevent blowouts. The term "casing string" is used herein to mean any string of pipe which is lowered into and cemented in a wellbore including but not limited to surface casing, liners and the like.

Typically, at the beginning of a cementing job, the casing and hole are filled with drilling mud. Very often, a bottom cementing plug is pumped ahead of the cement slurry to reduce contamination at the interface between the mud and cement. The bottom plug is typically constructed to have elastomeric wipers to wipe the casing of drilling mud and thereby separate the drilling mud ahead of the bottom plug from the cement slurry behind the bottom plug. The casing string will have a landing platform for the bottom plug. The landing platform may be a float collar, a float shoe or a shoulder in the casing string. When the bottom plug seats upon the landing platform, the fluid pressure differential created across the bottom plug ruptures a diaphragm at the top of the bottom plug and allows the cement slurry to proceed down the casing through the plug, through the float equipment at the lower end of the casing and up the annular space between the casing and the wellbore.

Once the required amount of cement has been displaced into the well, a top cementing plug, which will likewise have wipers thereon, may be displaced into the casing. The top cementing plug will follow the cement slurry into the casing, and is designed to reduce the possibility of any contamination or channeling of the cement slurry with drilling fluid or other fluid that is used to displace the cement column down into the casing and into the annular space between the casing and the wellbore. The top cementing plug does not have a fluid passage therethrough such that when it reaches the bottom cementing plug, the top cementing plug will cause a shut off of fluids being pumped through the casing.

Once the cement has set up and any other desired operations have been performed, the cementing plugs, along with float equipment therebelow, may be drilled out. In order to do so, the drill string with the drill bit thereon is lowered into the hole until the drill engages the top plug and is rotated. In many instances, however, when the drill bit is rotated, the top plug also begins to rotate on top of the bottom plug, or the bottom plug may rotate on the landing platform, whether the platform is float equipment or a shoulder or other restriction in the casing. Plug rotation costs valuable time and therefore has an economic impact on the cost of the well. Thus, there is a need to eliminate or at least limit the rotation of the cementing plugs during drillout after the cementing job. Several attempts have been made at limiting the rotation of the cementing plugs. One such attempt is described in International Application No. PCT/US00/40545, International Publication No. WO 01/09481 A1, entitled Anti-Rotation Device for Use with Well Tools. Another device for limiting the rotation of plugs is described in U.S. Pat. No. 5,095,980, which discloses a combination non-rotating plug set. Other devices and/or methods are shown in U.S. Pat. No. 5,390,736, U.S. Pat. No. 5,165,474 and U.S. Pat. No. 4,190,111. Although the apparatus and methods described therein may in some cases work well to limit rotation of cementing plugs during drillout, there is a continuing need for an anti-rotation apparatus and method which will consistently limit the rotation of the cementing plugs during drillout and which is easy to use, efficient and inexpensive.

SUMMARY OF THE INVENTION

The present invention provides an apparatus for preventing, or at least limiting the rotation of a cementing plug during drillout of the cementing plug. The apparatus includes an outer case, which preferably is a joint of casing. The outer case may be referred to as an outer housing or outer sleeve. An inner sleeve is disposed in the outer case. The inner sleeve has an open upper end and an open lower end and is adapted to receive cementing plugs displaced through a casing string during a cementing job. The inner surface of the sleeve is configured and dimensioned so as to cause an interference fit, and thus frictionally engage cementing plugs that are received therein. Engagement between the cementing plugs and the inner sleeve will prevent or at least limit rotation of the cementing plugs during drillout of the cementing plugs after a cementing job. The inner sleeves are preferably comprised of a durable, drillable material.

In one embodiment, the inner sleeve has a tapered inner surface. The tapered inner surface preferably tapers radially inwardly from the upper end of the inner sleeve to the lower end of the inner sleeve. The tapered inner surface may have a circular cross-section so that the inner surface has a generally frustoconical shape, or may define a polygonal cross-section, so that the inner surface defines a polyhedral shape. The apparatus of the present invention limits rotation of cementing plugs by engaging the plugs that are received therein so that when rotational drilling forces are applied, rotation of the plug is prevented or is at least limited.

BRIEF DESCRIPTION OF THE DRAWINGS

FIG. 6 shows a side cross-sectional view of an additional embodiment of an anti-rotation apparatus of the present invention.

FIG. 9 is a cross-sectional view of an additional embodiment of the anti-rotation apparatus of the present invention.

DESCRIPTION OF PREFERRED EMBODIMENTS

Figure 1:
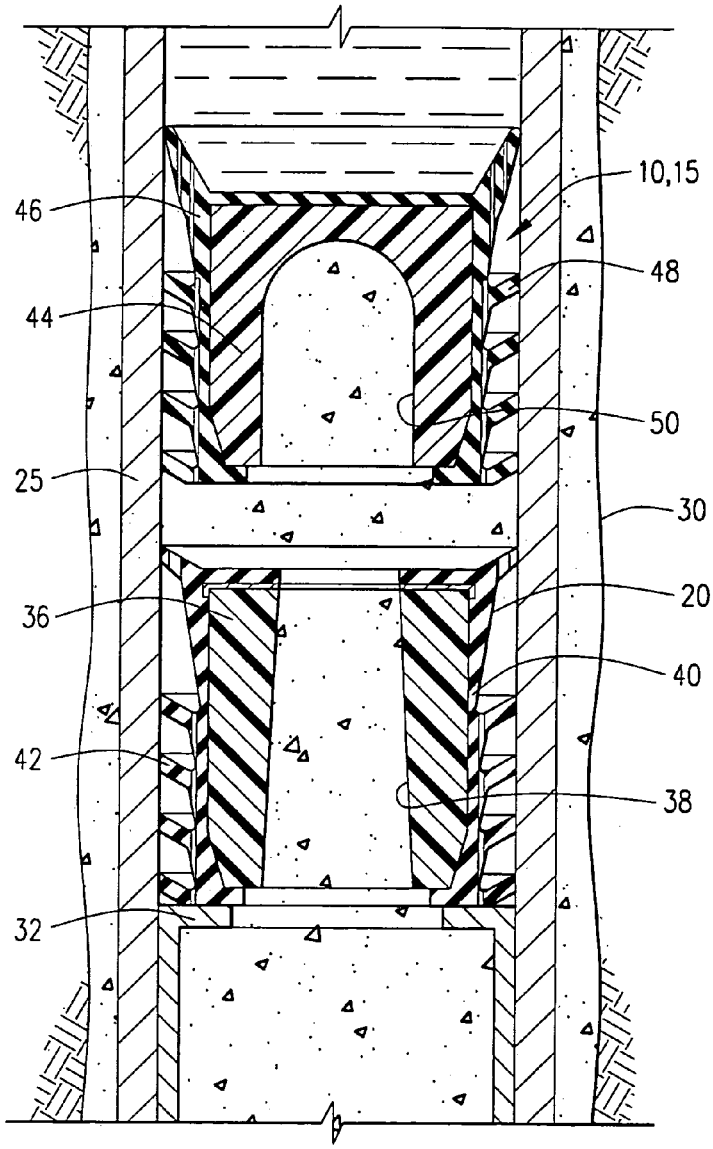
FIG. 1 PRIOR ART
FIG. 1 shows a side cross-sectional view of a prior art plug set displaced into a casing.

Referring now to the drawings and more particularly to FIG. 1, a prior art cementing plug set 10 is shown. Plug set 10 includes a top cementing plug 15 and a bottom cementing plug 20. The plug set 10 is shown in a casing 25 being cemented into a wellbore 30. Plug set 10 is shown after bottom cementing plug 20 has landed on a landing platform 32 which may comprise a float collar, float shoe or other float equipment, or any other restriction which will allow bottom cementing plug 20 to land, but which will also allow fluid flow therethrough. Bottom cementing plug 20 comprises a body 36 defining a flow passage 38 therethrough. Typically, a rupturable member will be disposed across the top of flow passage 38 such that when bottom cementing plug 20 lands, increasing fluid pressure will cause the rupturable member to burst so that fluid, such as the cement slurry, can flow through flow passage 38. In FIG. 1, the rupturable member has already been ruptured to allow flow through flow passage 38. Bottom cementing plug 20 also includes an elastomeric cover 40 disposed about body 36. Elastomeric cover 40 includes a plurality of wipers 42. As explained above, bottom cementing plug 20 will normally be placed in the casing ahead of the cement slurry to wipe off the inner surface of the casing and separate the drilling fluid from the cement slurry. Top cementing plug 15 has a body 44 with an elastomeric cover 46 disposed thereabout. Elastomeric cover 46 includes elastomeric wipers 48. Body 44 defines a central cavity 50.

As explained above, top cementing plug 15 is displaced into the casing above the cement slurry to separate the cement slurry from the drilling or other fluids thereabove utilized to urge the cement slurry downwardly through the casing and into the annulus between casing 25 and wellbore 30. FIG. 1 shows top cementing plug 15 prior to the time it engages and seats upon bottom cementing plug 20.

Figure 2:
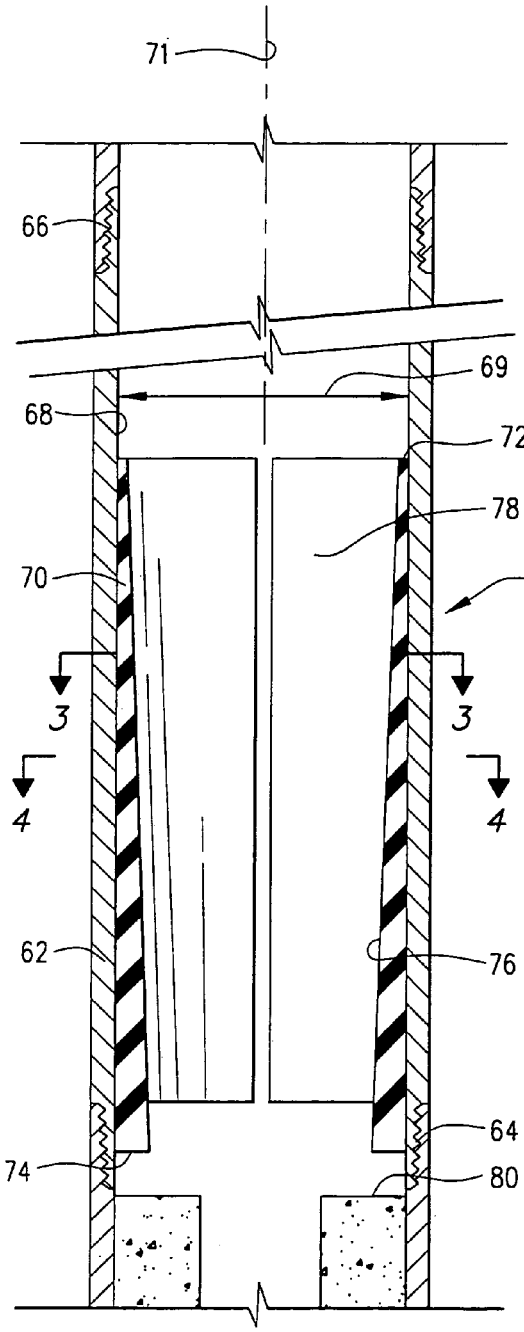
FIG. 2 shows a side cross-sectional view of an anti-rotation apparatus of the present invention.
Figure 3:
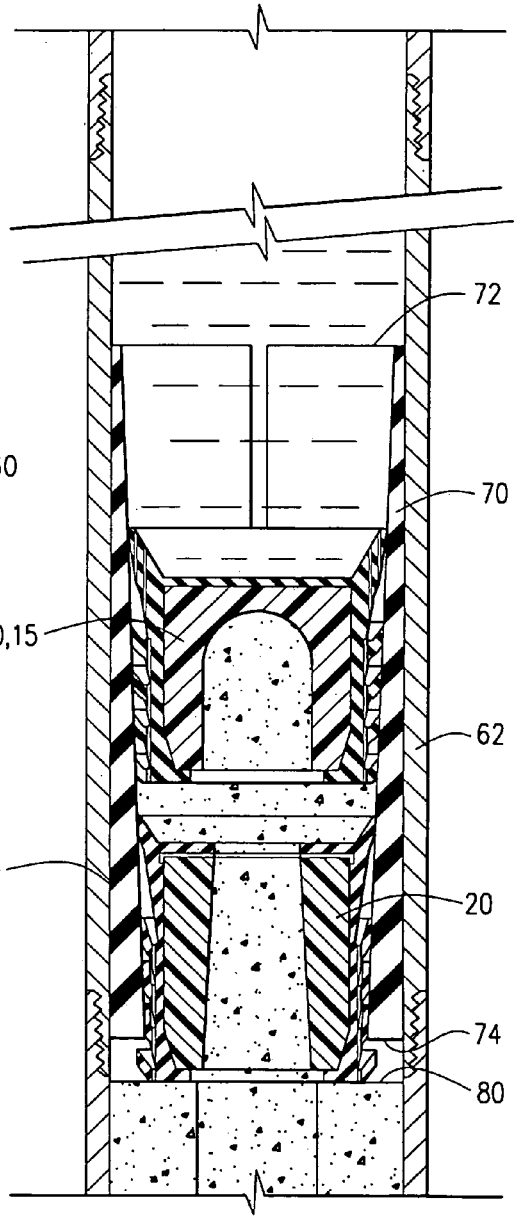

Referring now to FIG. 2, an apparatus 60 for limiting rotation of a cementing plug when rotational forces, such as forces applied by a drill bit during drillout, are applied. Apparatus 60 includes an outer case or outer housing 62. Outer case 62 preferably comprises a casing joint. Apparatus 60 can be threadedly connected in and will make up a part of a casing string lowered into a wellbore. Outer case 62 may also be referred to as a sleeve or outer sleeve 62. Outer case 62 has lower end 64 and upper end 66 and defines a passageway 68. Outer case 62 defines an inner diameter 69, which will preferably be substantially identical to the inner diameter of the casing string in which apparatus 60 is connected. Apparatus 60 has an inner sleeve 70 disposed in outer case 62. Inner sleeve 70 is preferably comprised of a drillable material.

Inner sleeve 70 has a longitudinal central axis 71, an upper end 72 and a lower end 74. Upper and lower ends 72 and 74 are open upper and lower ends and upper end 72 is adapted to receive cementing plugs, such as top and bottom cementing plugs 15 and 20.

Figure 3:
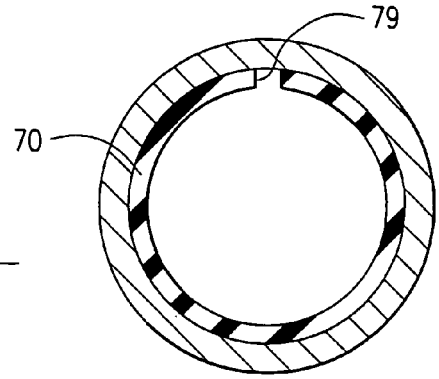
FIGS. 3 and 4 show sectional views taken from lines 3—3 and 4—4 of FIG. 2, respectively, and are directed to different embodiments of the anti-rotation apparatus of the present invention.
Figure 4:
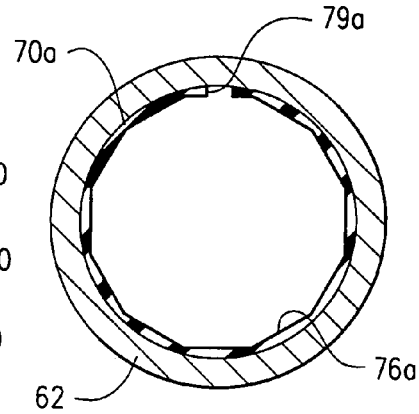

Inner sleeve 70 may comprise an insert that is adhesively or otherwise bonded to outer case 62 or may be molded to outer case 62. Inner sleeve 70 defines an inner surface, or inner profile 76. Inner surface 76 is preferably a tapered inner surface 76, and defines a passageway 78. A slot 79 may be defined through inner sleeve 70, and may extend from the upper to the lower end thereof. The slot will allow sleeves made as inserts to expand and compress to varying outer diameters so that the sleeves can be shaped to fit in a range of outer case inner diameters. In the embodiment shown, inner surface 76 tapers radially inwardly from the open upper end 72 to the open lower end 74 of inner sleeve 70. Inner surface 76 preferably has a constant taper defined thereon. In one embodiment, as shown in FIG. 3, inner surface 76 is circular in a cross-section taken perpendicular to longitudinal central axis 71. Thus, in the embodiment shown in FIG. 3, inner surface 76 is frustoconically shaped. In a second embodiment shown in FIG. 4, inner surface 76*a* may have a polygonal shape in a cross-section perpendicular to longitudinal central axis 71*a*. Preferably, in the embodiment shown in FIG. 4, inner surface 76*a* defines an equilateral polygon. In the embodiment shown in FIG. 4, the numeric designations include the subscript a so as to distinguish from the embodiment shown in FIG. 3. The embodiment in FIG. 3 has a frustoconically shaped inner surface, and the embodiment shown in FIG. 4 in cross-section, defines a polygon such that inner surface 76*a* may essentially define a polyhedron or a polyhedral shape.

Figure 5:
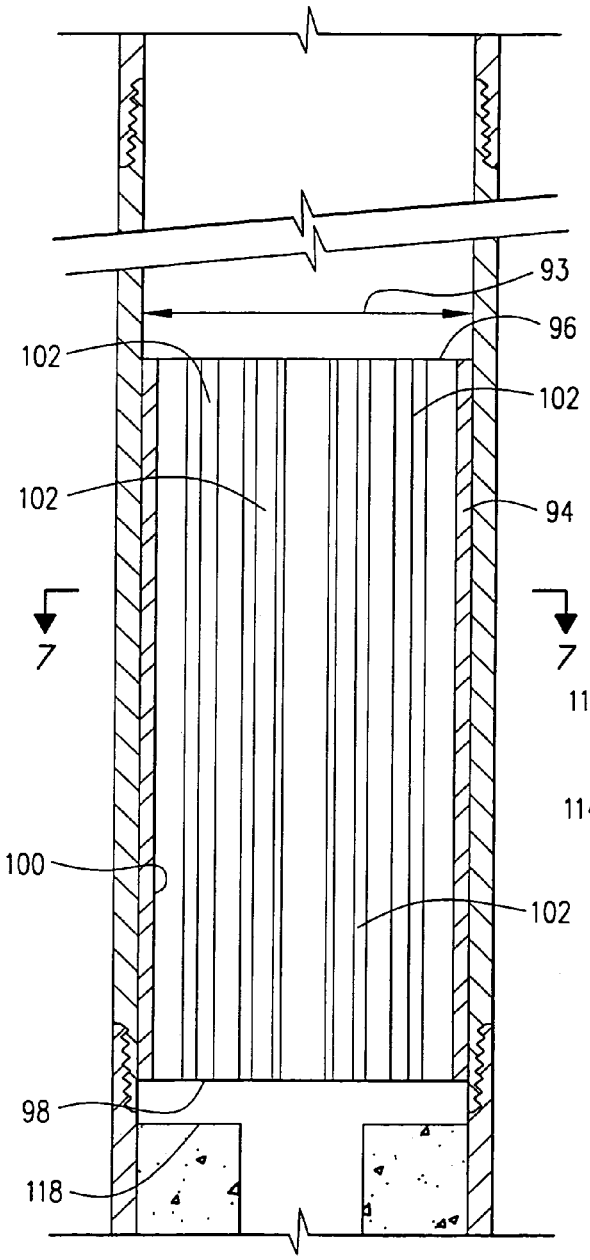
FIG. 5 shows a side cross-sectional view of the anti-rotation apparatus of the present invention with cementing plugs received therein.

FIG. 5 shows a plug set, such as plug set 10 in a casing string of which apparatus 60 is a part. As shown in FIG. 5, bottom cementing plug 20 has been displaced into the casing string and has engaged a landing platform 80 which as set forth above may comprise a float collar, a float shoe or other float equipment, or may comprise a shoulder or other restriction in the casing which provides a barrier to stop bottom cementing plug 20. Top cementing plug 15 is shown just prior to the time that it engages bottom cementing plug 20. Top and bottom cementing plugs 15 and 20 are received in the open upper end 72 of inner sleeve 70. Top and bottom cementing plugs 15 and 20 have an unrestrained outer diameter defined by the wipers thereon that is greater than inner diameter 69, and thus greater than the inner diameter of the casing 25, so that the plugs will effectively wipe the inner surface of the casing 25 as it passes therethrough. Top and bottom cementing plugs 15 and 20 will therefore be engaged by the inner surface of inner sleeve 70, or 70*a*, in the embodiment of FIG. 4, upon entering through the open upper end thereof. The thickness of inner sleeves 70 and 70*a* in the embodiments herein is shown exaggerated relative to the thickness of the wall of the outer case for purposes of clarity. As top and bottom cementing plugs 15 and 20 are displaced downwardly in passageway 78, the engagement, or interference with tapered inner surface 76 will increase. Inner sleeve 70 is preferably made from a durable, yet drillable material. Once the cementing job is complete, and bottom cementing plug 20 has reached landing platform 80 and top cementing plug 15 has landed on bottom cementing plug 20, it is necessary to drill out top and bottom cementing plugs 15 and 20 and any float equipment therebelow. The interference fit between inner sleeve 70 and top and bottom cementing plugs 15 and 20 will prevent, or at least limit, the rotation of the cementing plugs during drillout. In other words, when rotational forces are applied to drill out top and bottom cementing plugs 15 and 20, inner sleeve 70 will engage and hold top and bottom cementing plugs 15 and 20 in place. The discussion herein with respect to the embodiment in FIG. 3, applies equally to the embodiment of FIG. 4.

Figure 7:
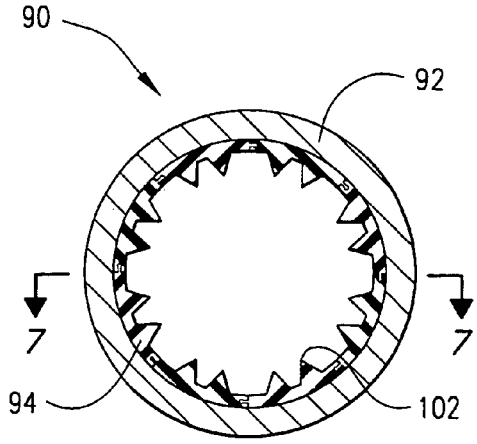
FIG. 7 shows a section view taken from line 7—7 of FIG. 6.
Figure 8:
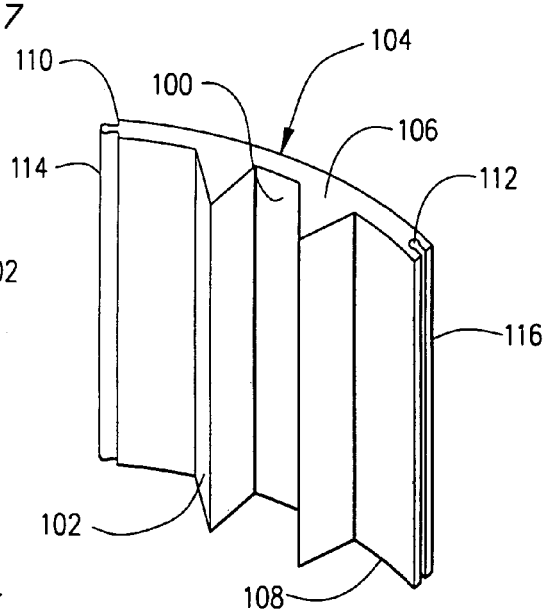
FIG. 8 is a perspective of a sleeve segment of the embodiment of FIG. 6.
Figure 8:
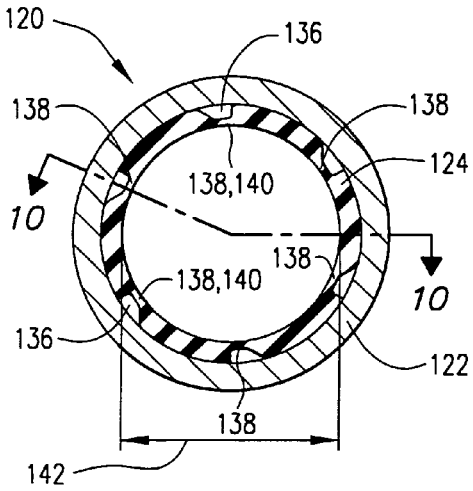

An additional embodiment of an apparatus for preventing or at least limiting rotation of a cementing plug when rotational forces, such as drilling forces, are applied thereto is shown in FIGS. 6–8 and is designated by the numeral 90. Apparatus 90 comprises an outer case or outer housing 92 having an inner diameter 93. Outer housing 92 is preferably a casing joint. An inner sleeve 94 is disposed in an outer case 92. Inner sleeve 94 may be an extruded or molded sleeve and is preferably adhesively or otherwise bonded to outer case 92. Inner sleeve 94 has open upper end 96 and open lower end 98. Inner sleeve 94 defines a generally cylindrical inner surface 100 having a plurality of protrusions 102 extending radially inwardly therefrom. Protrusions 102 preferably comprise ribs or teeth 102 extending from the upper end 96 to the lower end 98 of inner sleeve 94. Ribs 102 may be of any desired cross-sectional shape, and in the embodiment shown are generally triangular in cross-section.

Inner sleeve 94 is preferably comprised of a plurality of inner sleeve segments 104. Each sleeve segment has an upper end 106, a lower end 108 and first and second edges 110 and 112. First edge 110 has a boss 114 connected to and extending therefrom. A groove 116 is defined in inner sleeve segment 104 at second edge 112 thereof. Boss 114 is adapted to mate with and be received in groove 116 so the plurality of inner sleeve segments 104, and in the embodiment shown eight inner sleeve segments 104, can be secured together to form inner sleeve 94.

As is apparent, cementing plugs used in cementing jobs, like top and bottom cementing plugs 15 and 20 will be received in upper end 96 of inner sleeve 94 and will be displaced downwardly until they engage landing platform 118. Ribs 102 on inner sleeve 94 will engage the cementing plugs and will hold the plugs so that when rotational forces, such as drilling forces, are applied thereto, the rotation of the cementing plugs will be prevented, or will be limited during drillout.

Figure 11:
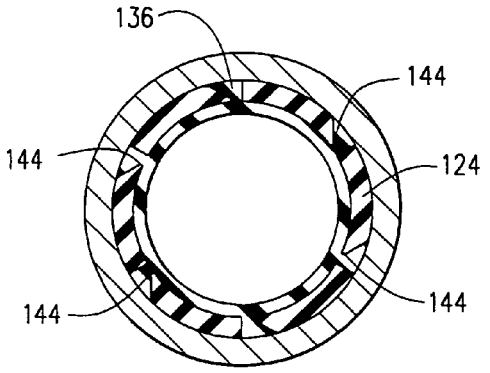
FIG. 11 is a cross-sectional view like that shown in FIG. 9 and shows a frangible portion of the embodiment of FIG. 9 broken as a result of cementing plugs being received therein.
Figure 10:
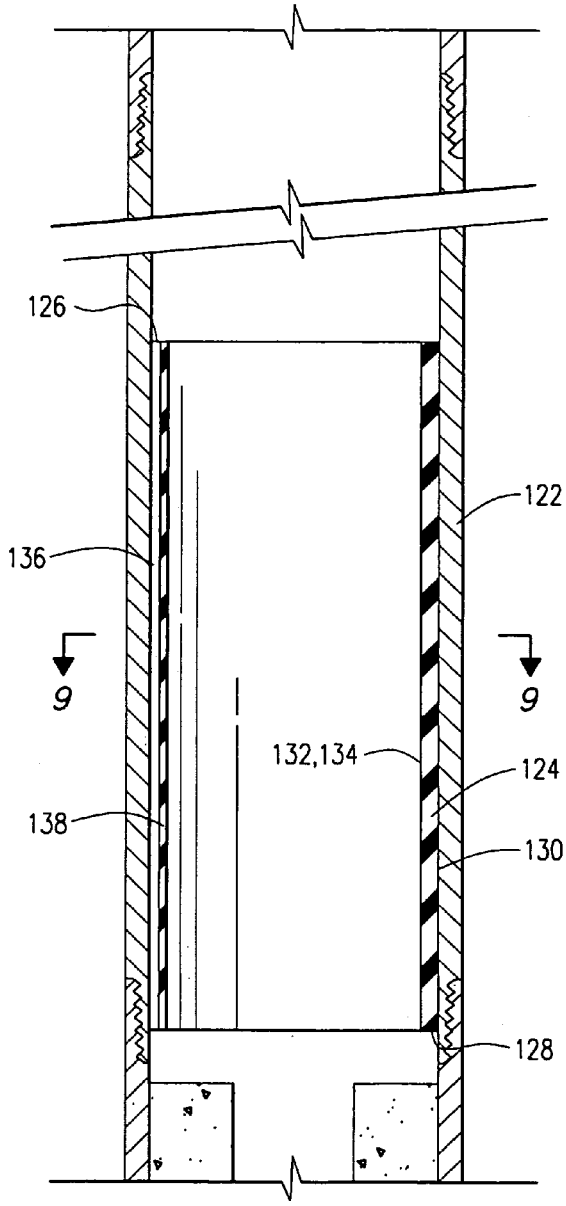
FIG. 10 is a view from line 10—10 of FIG. 9.

An additional embodiment of an apparatus for limiting rotation of a cementing plug in a casing string while rotational forces such as drilling forces, are applied thereto, is shown in FIGS. 9–11 and is generally designated by the numeral 120. Apparatus 120 comprises an outer case or outer housing 122 which is preferably a casing joint. An inner sleeve 124 is disposed in outer housing 122. Inner sleeve 124 preferably is comprised of a durable, drillable material. Inner sleeve 124 has upper end 126, lower end 128, outer surface 130 and inner surface 132 defining passageway 134. Inner sleeve 124 is a frangible inner sleeve, and may be made of a frangible plastic or composite, such as phenolic plastic. Inner sleeve 124 has a plurality of grooves 136 defined in the outer surface 130 thereof. Each groove 136 defines a frangible section 138. The plurality of frangible sections 138 may be collectively referred to herein as frangible portion 140.

Inner sleeve 124 defines an inner diameter 142. Inner diameter 142 is smaller in magnitude than the outer diameter of the cementing plugs to be received therein. Thus, cementing plugs, such as top and bottom cementing plugs 15 and 20 will be received in the open upper end 126 of inner sleeve 124 and will engage the inner surface 132 thereof. Inner sleeve 124 has an expandable profile such that cementing plugs received therein will apply forces to inner sleeve 124 as the cementing plugs are displaced downwardly therethrough. The interference between the cementing plugs and inner sleeve 124 will cause frangible portion 140 to break, thus, as shown in FIG. 11, exposing a plurality of edges 144. Thus, inner sleeve 124 has an expandable profile that will break along frangible portion 140 when cementing plugs are received therein. Edges 144 are exposed when frangible portion 140 breaks. Rotational forces applied to the cementing plug during drillout will attempt to rotate the cementing plugs received in inner sleeve 124. Edges 144 will engage the cementing plugs, and preferably the wipers thereon, to prevent or limit rotation. As shown in FIG. 11, material from cementing plugs may be extruded into grooves 136 as drilling forces are applied to the cementing plug, which will aid in preventing, or at least limiting the rotation of cementing plugs during drillout.

Figure 12:
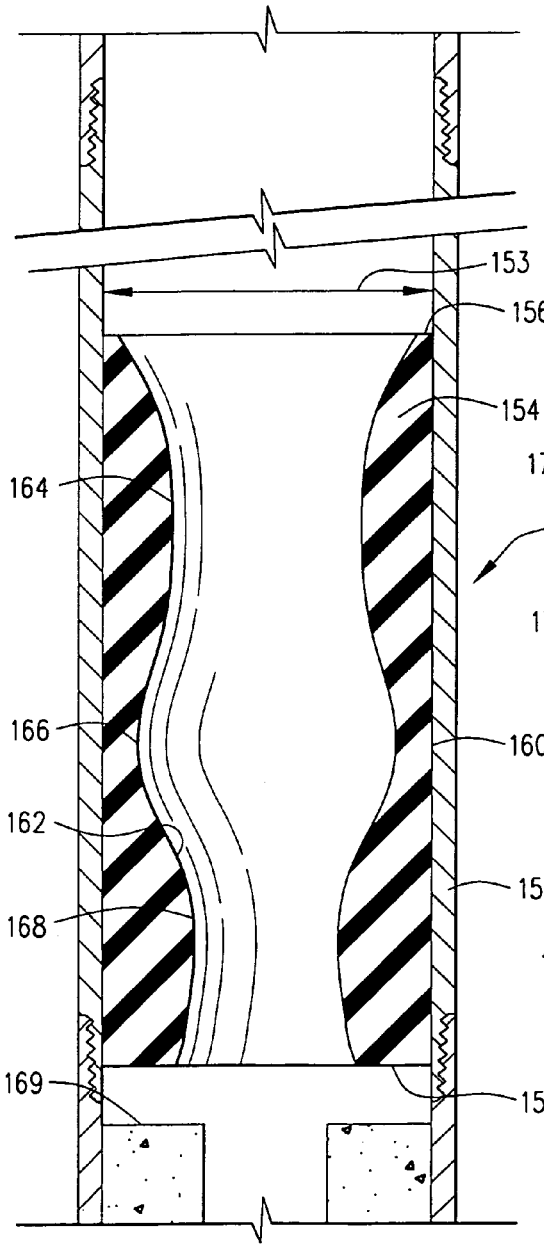
FIG. 12 shows a side cross-sectional view of an additional embodiment of an anti-rotation apparatus of the present invention.

An additional embodiment of an apparatus for preventing, or limiting the rotation of cementing plugs during drillout is shown in FIG. 12 and is generally designated by the numeral 150. Apparatus 150 comprises an outer case or outer housing 152 having inner diameter 153. Outer housing 152 preferably is a casing joint. Apparatus 150 further includes an inner sleeve 154 preferably comprised of a durable material having an upper end 156, a lower end 158, an outer surface 160 and an inner surface 162, which comprises a plurality of curved inner surfaces. In the embodiment shown, the curved, or arcuately shaped inner surfaces curve radially inwardly from both the upper and lower ends. Inner surface 162 curves radially inwardly from upper end 156 thereof to a first inner diameter 164 and then curves radially outwardly therefrom to second inner diameter 166 which is larger than first inner diameter 164. Inner surface 162 curves radially inwardly from second inner diameter 166 to a third inner diameter 168. Apparatus 150 thus has multiple tapered or curved surfaces to provide an engagement surface for cementing plugs received therein. Inner surface 162 may be generally said to define an hourglass shape. Cementing plugs, such as top and bottom cementing plugs 15 and 20, will be received in the open upper end 156 of inner sleeve 154. Cementing plugs received in inner sleeve 154 will be engaged by inner surface 162. Once the cementing job is complete, such that bottom cementing plug 20 has landed, or seated on a landing platform such as landing platform 169, inner surface 162 will engage cementing plugs to prevent, or at least limit the rotation of the cementing plugs during drillout.

Figure 14:
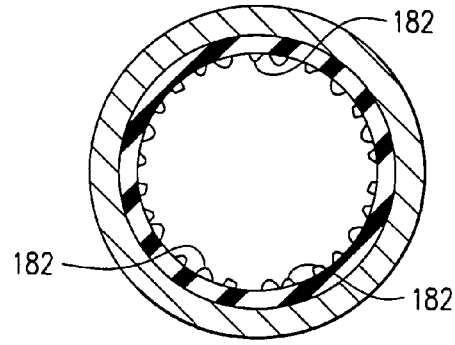
FIG. 14 is a view from line 14—14 of FIG. 13.
Figure 13:
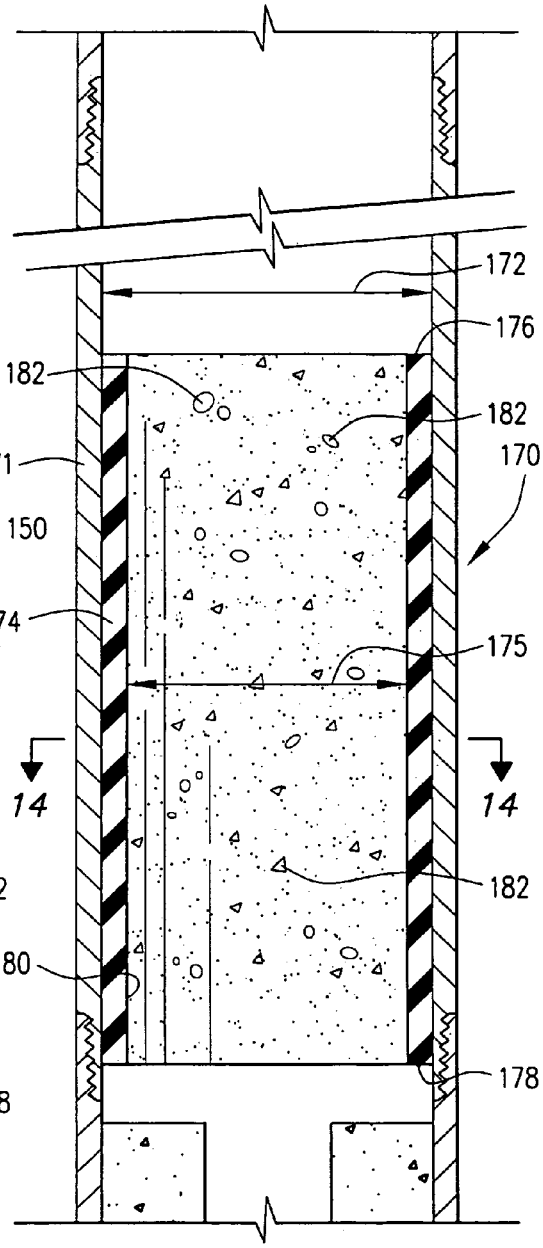
FIG. 13 shows a side cross-sectional view of an additional embodiment of an anti-rotation apparatus of the present invention.

An additional embodiment for an apparatus for preventing, or limiting the rotation of cementing plugs during drillout is shown in FIGS. 13 and 14 and is generally designated by the numeral 170. Apparatus 170 comprises an outer case or outer housing 171 which is preferably in a casing joint. Outer case 171 has an inner diameter 172, and has a durable material 174 affixed thereto defining an inner dimension 175 that will engage and thus cause an interference fit with cementing plugs received therein. Durable material 174 has an open upper end 176 and an open lower end 178, and defines an inner surface 180. The method of making apparatus 170 may comprise spraying durable material 174 on the inner diameter 172 of outer casing 171 to a sufficient thickness such that it will cause an interference fit with cementing plugs received therein. The method may further comprise placing aggregate material 182 in durable material 174. The aggregate material may be sprayed onto outer case 171 with durable material 174 or may be placed in or sprayed into durable material 174 after such material has been sprayed on outer case 171. Aggregate material 182 may include material such as sand, gravel, walnut hulls, fiberglass and, as set forth above, can be added to the spray on durable material either during or following the spray operation. The aggregate material will give apparatus 170 a rough surface that will provide friction with the cementing plugs and thus limit or prevent rotation of the cementing plugs during drillout. The durable material to be sprayed on inner surface or outer case 171 can be any durable material that would bond to the outer casing and that will withstand fluid flow, such as two-part epoxies, rubber, urethane and other thermoplastics. Rather than spraying, adhesives such as an epoxy-type adhesive can be applied to the outer case 171 by any means known in the art, and aggregate material can be sprayed or otherwise placed in the adhesive. An additional method for making apparatus 170 comprises fabricating a sandpaper-like sheet of durable material with aggregate therein, and gluing, or otherwise affixing the sheet to outer case 171.

Thus, the present invention is well adapted to carry out the object and advantages mentioned as well as those which are inherent therein. While numerous changes may be made by those skilled in the art, such changes are encompassed within the spirit of this invention as defined by the appended claims.

What is claimed is:

1. Apparatus for preventing rotation of a cementing plug in a well casing during drillout after cementing operations, the apparatus comprising:

an outer housing connected in the well casing;

an inner sleeve disposed in the outer housing, the inner sleeve having open upper and lower ends, wherein an inner surface of the inner sleeve curves radially inwardly from the upper end of the inner sleeve, so that the inner sleeve will engage and cause an interference fit with an outermost diameter of the cementing plug when the cementing plug is received therein, the interference fit being sufficient to prevent or limit rotation of the cementing plug during drillout of the cementing plug; and a restriction positioned in the well casing to stop downward movement of the cementing plug when at least a portion of the cementing plug is located in the inner sleeve.

2. The apparatus of claim 1, wherein the sleeve defines an innermost diameter between the upper and lower ends, wherein the inner surface of the inner sleeve diverges radially outwardly in both upward and downward directions from the innermost diameter.

3. The apparatus of claim 1, wherein the inner surface generally defines an hourglass shape.

4. The apparatus of claim 1, wherein the inner sleeve is adapted to receive at least two cementing plugs, wherein the inner sleeve will frictionally engage both of the cementing plugs to limit rotation of the cementing plugs during drillout thereof.

5. The apparatus of claim 1, the inner sleeve having multiple curvatures on the inner surface thereof.

6. The apparatus of claim 5, the inner surface generally defining an hourglass shape.

7. Apparatus for preventing rotation of a cementing plug during drillout of the cementing plug after cementing operations comprising:

a restriction placed in a well casing to stop downward movement of the cementing plug in the well casing; and an inner sleeve for insertion into a casing, the restriction being positioned so that downward movement of the cementing plug stops when a surface of the inner sleeve is engaged with the cementing plug, the inner sleeve having upper and lower ends, the inner surface of the sleeve having multiple curvatures thereon, wherein each curvature extends radially inwardly to define a diameter having a magnitude less than a maximum diameter of the inner surface of the sleeve, and wherein the cementing plug will be engaged by the inner surface of the inner sleeve at the diameters defined by the curvatures, the engagement between the inner sleeve and the cementing plug being sufficient to limit rotation of the cementing plug during drillout.

8. Apparatus of claim 7, wherein the inner surface of the inner sleeve defines an hourglass shape.

9. Apparatus of claim 7, wherein the inner surface diverges radially outwardly from an innermost diameter upwardly and downwardly.

10. Apparatus of claim 7, wherein the inner surface curves radially inwardly from both the upper and lower ends of the sleeve.

11. Apparatus of claim 7, wherein the inner surface of the sleeve diverges radially outwardly from multiple locations between the upper and lower ends of the sleeve.

12. Apparatus for preventing rotation of a cementing plug during drillout of the cementing plug after cementing operations comprising:

an outer housing for connecting in a casing string;

an inner sleeve affixed to the outer housing, the inner sleeve having multiple curvatures on an inner surface thereof, wherein each curvature extends radially inwardly to define a diameter having a magnitude less than a maximum diameter of the inner surface, and wherein the cementing plug will be engaged by the inner surface at the innermost diameters defined by the curvatures, the amount of engagement being sufficient to limit rotation of the cementing plug during drillout; and a restriction positioned in the casing string to stop the downward movement of the cementing plug when at least a portion of the cementing plug is located in the inner sleeve.

13. The apparatus of claim 12, the inner sleeve having a length such that two cementing plugs may be received therein.

14. The apparatus of claim 12, wherein the inner surface of the inner sleeve has an hourglass shape.

15. The apparatus of claim 12, wherein the inner surface converges from both an upper and lower end of the inner sleeve.

16. Apparatus for preventing rotation of a cementing plug during drillout after cementing operations, the apparatus comprising:

an outer housing;

an inner sleeve disposed in the outer housing, the inner sleeve having open upper and lower ends, wherein an inner surface of the inner sleeve curves radially inwardly from the upper end of the inner sleeve, so that the inner sleeve generally defines an hourglass shape and will cause an interference fit with the cementing plug when the cementing plug is received therein.

17. The apparatus of claim 16, wherein the inner sleeve is adapted to receive at least two cementing plugs, wherein the inner sleeve will frictionally engage both of the cementing plugs to limit rotation of the cementing plugs during drillout thereof.

* * * * *